US008800827B2

(12) United States Patent
Choi

(10) Patent No.: US 8,800,827 B2
(45) **Date of Patent: *Aug. 12, 2014**

(54) BOX AND FORM FOR WIG OR HAIR PIECE

(75) Inventor: Kyung Ja Kay Choi, Great Neck, NY (US)

(73) Assignee: Hair Zone, Inc., Moonachie, NJ (US)

( * ) Notice: Subject to any disclaimer, the term of this patent is extended or adjusted under 35 U.S.C. 154(b) by 890 days.

This patent is subject to a terminal disclaimer.

(21) Appl. No.: 12/456,301

(22) Filed: Jun. 15, 2009

(65) Prior Publication Data

US 2012/0006696 A1 Jan. 12, 2012

(51) Int. Cl.
*D06C 15/00* (2006.01)

(52) U.S. Cl.
USPC ..... 223/66; 206/278; 223/24

(58) Field of Classification Search
USPC ..... 223/24, 25, 1, 26, 66; 221/33; 132/54–55, 201, 53, 56; 206/8, 278, 206/303
See application file for complete search history.

(56) References Cited

U.S. PATENT DOCUMENTS

| | | | | | |
|---|---|---|---|---|---|
| 289,957 | A | | 12/1883 | Baxter | |
| 2,409,055 | A | * | 10/1946 | McCann | 2/209 |
| 3,154,027 | A | * | 10/1964 | Belshaw | 425/182 |
| D215,902 | S | | 11/1969 | Cohen | |
| D215,907 | S | | 11/1969 | Little | |
| 3,512,301 | A | * | 5/1970 | Kramer | 446/71 |
| 3,521,883 | A | * | 7/1970 | Hamilton | 473/437 |
| D220,230 | S | | 3/1971 | Friedman | |
| 3,626,955 | A | | 12/1971 | Greenwood | |
| 3,746,293 | A | * | 7/1973 | Silvia | 248/162.1 |
| 3,777,951 | A | | 12/1973 | Newsteder | |
| 3,969,080 | A | * | 7/1976 | Conlon | 422/547 |
| 4,015,940 | A | * | 4/1977 | Conlon | 422/566 |
| 4,485,585 | A | * | 12/1984 | Shackelford et al. | 446/117 |
| 4,943,225 | A | * | 7/1990 | Prater | 425/275 |
| 5,234,370 | A | | 8/1993 | Shapero et al. | |
| 5,816,265 | A | * | 10/1998 | Ringo | 132/55 |
| 2006/0005986 | A1 | * | 1/2006 | Alcoe | 174/52.1 |
| 2009/0289088 | A1 | * | 11/2009 | Choi | 223/84 |
| 2011/0132942 | A1 | * | 6/2011 | Choi | 223/66 |
| 2012/0006696 | A1 | * | 1/2012 | Choi | 206/8 |

OTHER PUBLICATIONS

U.S. Appl. No. 12/154,037, Choi, 2008 (not published).

* cited by examiner

*Primary Examiner* — Clinton Ostrup
*Assistant Examiner* — Andrew Sutton
(74) *Attorney, Agent, or Firm* — Venable LLP

(57) ABSTRACT

A box and/or form for a wig or hair piece are provided. The form may include a torus-shaped member and a mandrel. In use, the wig or hair piece may be wrapped about or otherwise secured to the mandrel and the mandrel may be placed within a lumen of the torus-shaped member. A curved or curled portion of the strands of hair of the wig or hair piece may extend over a curved surface of the torus-shaped member. The wig form and attached wig or hair piece may be covered with a hairnet and may be placed in a box for sale to a consumer or for storage by the consumer after sale. Embodiments allow the display before sale and convenient storage of wigs and hair pieces by the consumer while preserving the curl of the hair.

15 Claims, 4 Drawing Sheets

BOX AND FORM FOR WIG OR HAIR PIECE

CROSS-REFERENCES TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

REFERENCE TO A "SEQUENCE LISTING," A TABLE, OR A COMPUTER PROGRAM LISTING APPENDIX

Not Applicable.

BACKGROUND

Embodiments include boxes and forms for preserving, storing, and displaying wigs or hair pieces or hair extensions.

DESCRIPTION OF RELATED ART INCLUDING INFORMATION DISCLOSED UNDER 37 CFR 1.97 AND 37 CFR 1.98

U.S. Pat. No. 289,957 discloses a method in which hair is woven about bars and secured by wires before treatment to impart permanent waves.

U.S. Pat. No. 3,626,955 discloses a connector in which in one portion strands of a wig are forced through a collar and secured in place by a ball-like fastener. The collar is attached to similar device connected to the user's hair.

U.S. Pat. No. 3,746,293 discloses a wig block which is secured in place by a weighted collar about the bottom of the block.

U.S. Pat. No. 3,777,951 discloses an inflatable wig stand with a simulated head with an inflatable collar-base which forms an air seal with a supporting surface; the air-seal stabilized the stand.

U.S. Pat. No. 5,234,370 discloses a doll wig which is curled over a generally cylindrical curling rod.

U.S. Pat. No. D215,902 discloses a wig styling tray with an apparent mandrel surrounded by a saucer-shaped dish.

U.S. Pat. No. D220,230 discloses a wig styling tray with an apparent mandrel surrounded by a saucer-shaped dish.

U.S. patent application Ser. No. 12/154,037, filed May 20, 2008, incorporated herein by reference, discloses a wig or hair piece box and form. The form has the general shape of a user's head.

None of the prior art wig or hair piece boxes, with the exception of the incorporated reference, deals with the problem of loss of style and curl or deals with the preservation of one directional curl and style of stored wigs and hair pieces. Embodiments of the present disclosure solve this long-recognized need.

Embodiments of the present disclosure meet the need for a compact wig and hair piece box which allows efficient transport, storage and display of the contained wig or hair piece before it is sold to a consumer, and thereafter allows convenient compact storage of the wig or hair piece by the consumer, at all times maintaining the curl of the wig strands.

The foregoing examples of the related art and limitations related therewith are intended to be illustrative and not exclusive. Other limitations of the related art will become apparent to those of skill in the art upon a reading of the specification and a study of the drawings.

BRIEF SUMMARY

The following embodiments and aspects thereof are described and illustrated in conjunction with systems, tool and methods which are meant to be exemplary and illustrative, not limiting in scope. In various embodiments, one or more of the above-described problems have been reduced or eliminated, while other embodiments are directed to other improvements.

Embodiments include a wig form for supporting a wig or hair piece which comprises a cylindrical mandrel, and a torus-shaped doughnut, the mandrel located within the lumen of the torus-shaped doughnut, the mandrel unattached to the torus-shaped doughnut.

Other embodiments include the process of placing a wig or hair piece on a wig form comprising the steps, obtaining a wig form comprising a cylindrical mandrel, and a torus-shaped doughnut, the mandrel located within the lumen of the torus-shaped doughnut, the mandrel unattached to the torus-shaped doughnut, obtaining a wig or hair piece having a weft track with curved strands of hair having a root end and a tip end attached along the length of the weft track at the root ends, the strands of hair having a curl, the curl of substantially all of the strands of hair of the wig or hair piece parallel to each other, wrapping the well track about the mandrel, placing the mandrel bearing the wig or hair piece within the lumen of the torus-shaped doughnut, and placing the tip ends of the strands over the torus-shaped doughnut with the curve of the strands of hair contiguous with and covering the curved surface of the torus-shaped doughnut.

Other embodiments include a wig or hair piece box comprising, in combination, an approximately square base having a floor and four vertical walls, a circular retainer comprised of a band having a height approximately that of the vertical walls of the base, the retainer located within the base, a cylindrical mandrel having a height approximately that of the vertical walls of the base, a torus-shaped doughnut having a height approximately that of the vertical walls of the base and having an exterior diameter approaching that of the retainer, the torus-shaped doughnut located within the retainer, and the mandrel located within the lumen of the torus-shaped doughnut, and an approximately square lid, the lid having vertical walls which interact with the walls of the base when the box is closed by the lid.

Other embodiments include a wig or hair piece box comprising, in combination, an approximately square base having a floor and four vertical walls, a circular retainer comprised of a band having a height approximately that of the vertical walls of the base, the retainer located within the base, a cylindrical mandrel having a height approximately that of the vertical walls of the base, a torus-shaped doughnut having a height approximately that of the vertical walls of the base and having an exterior diameter approaching that of the retainer, the torus-shaped doughnut located within the retainer, the mandrel located within the lumen of the torus-shaped doughnut, and an approximately square lid having vertical walls, the walls interacting with the walls of the base when the lid closes the box, a wig or hair piece having a weft track with curved strands of hair having a root end and a tip end attached along the length of the weft track at the root ends, the strands of hair having a curl, the curl of substantially all of the strands of hair of the wig or hair piece parallel to each other, the weft track of the wig or hair piece wrapped about the mandrel, the mandrel bearing the wig or hair piece placed within the lumen of the torus-shaped doughnut, and the curl of the strands of hair of the wig or hair piece placed over the torus-shaped doughnut, the strands of hair contiguous with and covering the curved surface of the torus-shaped doughnut.

In addition to the exemplary aspects and embodiments described above, further aspects and embodiments will become apparent by reference to the drawings and by study of the following descriptions.

DETAILED DESCRIPTION

In this disclosure the term "wig" means an easily detachable manufactured covering of natural or synthetic hair for the head. The term "hair piece" means natural or synthetic hair which is either woven to a user's natural hair for long term use or detachable attachment for short term use, commonly termed a weave or hair extension. The term "weft" means a collection of multiple strands of natural or synthetic hair, attached together by intricate stitched work with a sewing machine or fused together by glue and woven material, which is treated as a unit in the manufacture and styling or making of a wig or hair piece. The term "weft track" means a strip, stitched or fused sction, to which wefts or strands of hair are attached. The term "root end" means the end of hair which is stitched or fused together to the weft track, which is to be attached to the wig supporting fabric or base cap, or to the user's natural hair in the case of a hair piece. The term "tip end" means the opposite ends of the strands of hair or weft which is not attached to the wig or hair piece supporting fabric or base cap or to user's natural hair.

Figure 1:
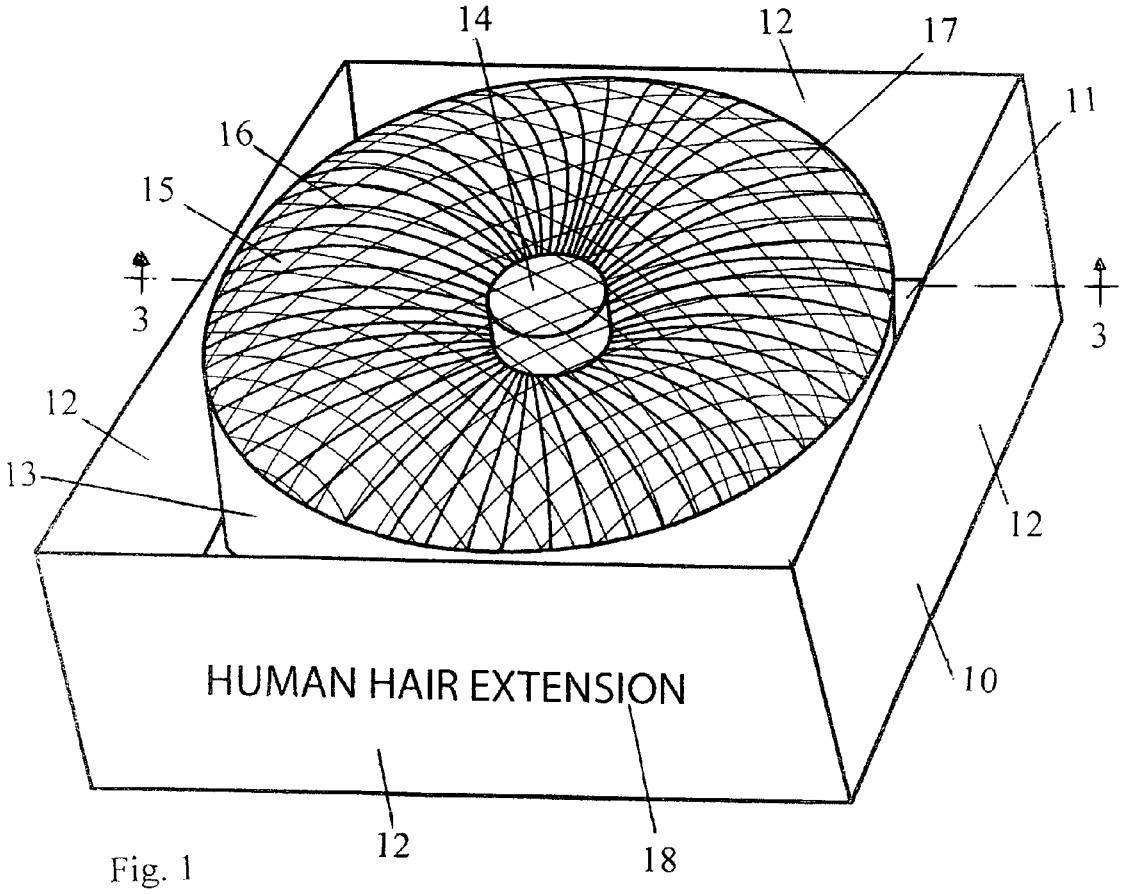
FIG. 1 is a perspective view of an embodiment wig or hair piece box containing a wig or hair piece with the box lid removed.

FIG. 1 is a perspective view of an embodiment wig or hair piece box 10 containing a wig or hair piece with the box lid removed. Visible in FIG. 1 is the approximately square base 11, vertical walls 12, circular band retainer 13, cylindrical mandrel 14, torus-shaped doughnut 15 (not visible in FIG. 1 as covered by wefts of hair of the wig or hair piece 16), and wefts or strands of hair of the wig or hair piece 16. Descriptive indicia 18 may be located on the box.

Figure 2:
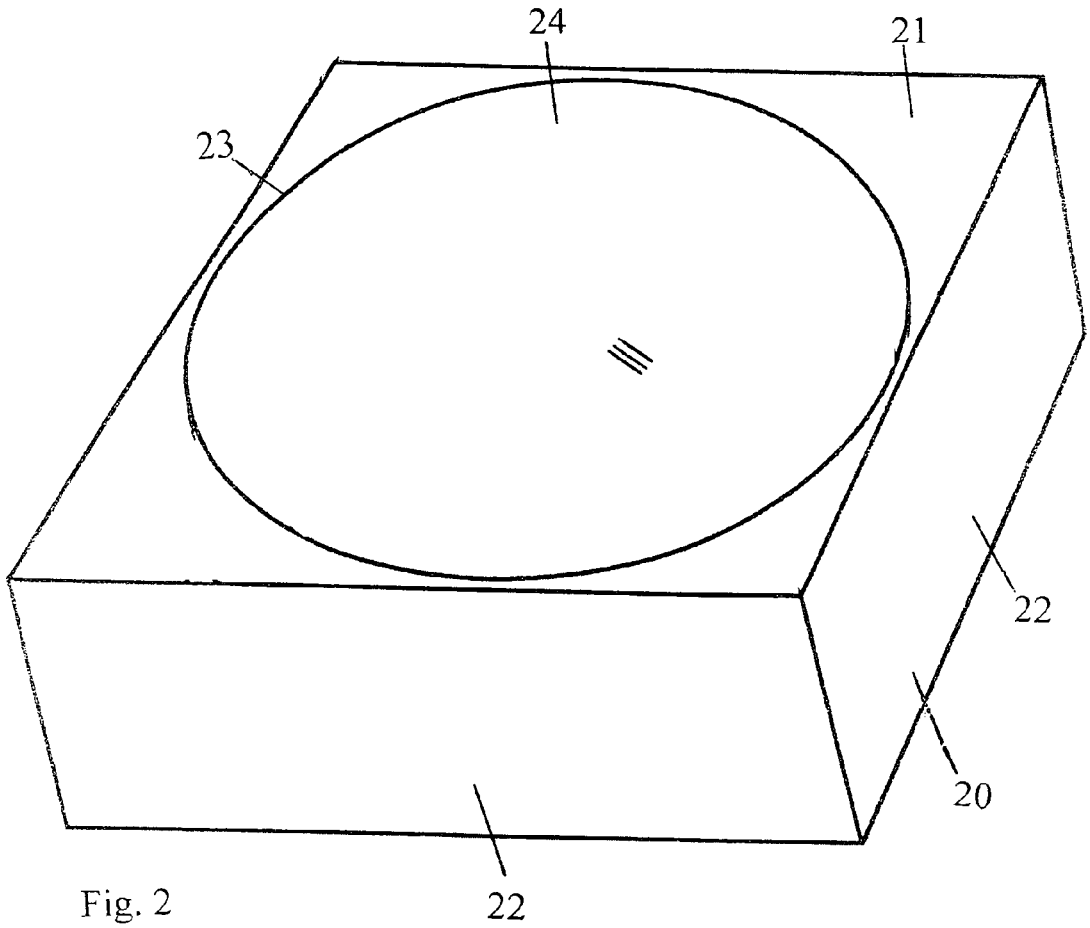
FIG. 2 is a perspective view of the lid of an embodiment wig or hair piece box lid.

FIG. 2 is a perspective view of the lid 20 of an embodiment wig or hair piece box lid. Visible in FIG. 2 is the approximately square lid top 21, the vertical walls 22, an optional window 23, and an optional transparent window pane 24.

Figure 3:
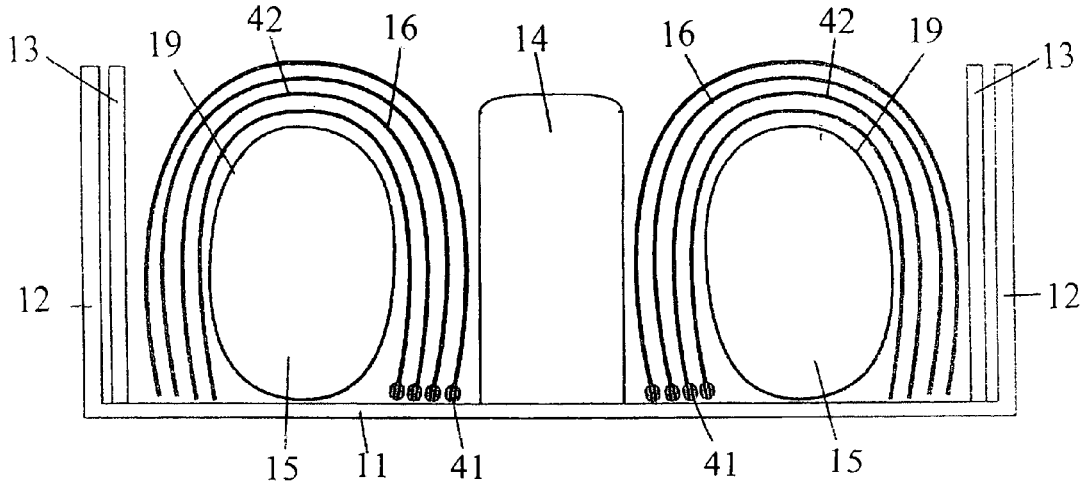
FIG. 3 is a cross-section view of the embodiment wig or hair piece box of FIG. 1 taken at line 3.

FIG. 3 is a cross-section view of the embodiment wig or hair piece box of FIG. 1 taken at line 3. Visible in FIG. 3 is the base 11, the vertical walls 12, the retainer 13, mandrel 14, and torus-shaped doughnut 15. Also visible in FIG. 3 is the wig or hair piece 16 which is comprised of weft track 41, and wefts or strands of hair 42 which are curved over the curved surface 19 of the torus-shaped doughnut 15. One or more wigs or hairpieces 16 are depicted in FIG. 3, with several weft tracts 41 shown wrapped about the mandrel 14. Although weft tracks 41 are depicted in FIG. 3 as separated from each other for clarity of FIG. 3, in actual embodiments the weft tracks 41 are pressed against and overlap each other when would about the mandrel 14.

Figure 4:
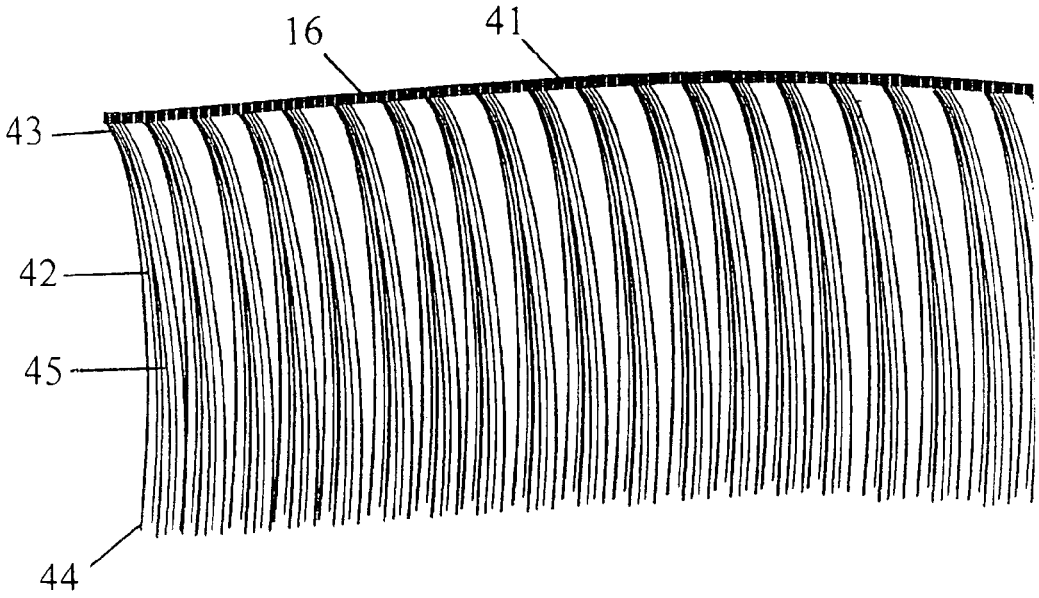
FIG. 4 is a side view of a portion of an embodiment hair extension.

FIG. 4 is a side view of a portion of an embodiment wig or hair piece 16. Visible in FIG. 4 is a weft track 41, weft or strands of hair 42, the wefts comprised of a root end 43 which is attached to the weft track 41, and free tip end 44, and a curved weft shaft 45.

Embodiments of wig or hair piece boxes were manufactured by any suitable thin, flexible, durable material, such as cardboard or plastic strips. The transparent pane was manufactured any suitable transparent material such as plastic, glass, or cellophane. It is anticipated that the outer surfaces of the boxes will have indicia relating to the box contents. Embodiments include square wig or hair piece boxes about 5½ inches length and width, and about 2 inches in height. Boxes of differing size to accommodate a variety of wigs and hair pieces are specifically anticipated.

Embodiment forms are manufactured of any suitable strong, resilient material. Suitable materials include foamed plastics, some examples of which are polystyrene, polybutadiene, polyurethane, and polyethylene. Other embodiments include forms manufactured of cardboard or papier-mache. Other embodiment forms are manufactured of flexible plastic or rubber, are bag-like in structure, and are filled with a fluid such as air or water.

Embodiment forms have cylindrical mandrels with a diameter of about ¾ inch and height of about 1½ inches. Embodiment torus-shaped doughnuts have an outside diameter of about 5 inches, internal lumen of about 3 inches, and thickness of the doughnut of about 1 inch. It is specifically contemplated that the dimensions of embodiments will vary according to the dimensions of the wigs used with the forms.

Visible in FIG. 4 is a portion of a wig or hair piece 16. This wig comprises an elongated band or weft track 41 and wefts or strands of hair 42 are fixedly attached to the band or weft track by the root end 43. In embodiments the hair piece is about 18 inches in length. In embodiments the band is about 12-24 inches in length. In embodiments there are about 18 wefts per inch of band. In embodiments there are about 12-24 wefts per inch of band. In embodiments wefts of hair consist of 10 to 50 strands of hair. In embodiments the length of hair is about 4 inches. In embodiments the length of hair is about 3 to 8 inches long. In embodiments the shafts 45 of the wefts, are curled, with the curl of all hair strands substantially parallel to each other, termed a "one directional curl". The free ends of the wefts are tip 44 ends.

Although embodiment wigs and hair pieces have wefts of hair comprised of human hair, the use of wigs and hair pieces with wefts of hair comprised of synthetic hair or animal hair is specifically contemplated.

In use, in embodiments, a first end of the elongated band or weft track 41 is removably wrapped about the mandrel 14 as shown in FIG. 2. Typically several weft tracks are consolidated into a bundle and wrapped about the mandrel. The weft or strands 42 are arrayed substantially parallel to each other and extend centrifugally away from the mandrel with the wefts overlapping each other and extending over the torus-shaped doughnut with the curled shafts 45 of the wefts substantially curled around the curved surface 19 of the torus-shaped doughnut, preserving the one directional curl of the wig or hair piece.

Although embodiments of the box and form are described in this application in connection with a wig comprised of an elongated band or weft track with attached wefts, it is specifically contemplated that other types of wigs also can be used in connection with the disclosed wig boxes and forms.

Although embodiments of the form are described in this application in connection with a wig or hair piece, it is specifically contemplated that forms can be used to hold any hair pieces with the associated preservation of the original style and one directional curl.

Embodiments of the disclosed wig boxes and forms are used both for the packaging and display of wigs and hair pieces for sale by manufacturers, as well as for use by consumers to conveniently store and preserve the condition of wigs and hair pieces when not in use, especially for preservation of the curl on the strands of hair. Embodiment boxes and forms allow convenient storing and displaying wigs or hair pieces while requiring a minimal amount of space.

While a number of exemplary aspects and embodiments have been discussed above, those of skill in the art will recognize certain modifications, permutations, additions and subcombinations thereof. It is therefore intended that the following appended claims and claims hereafter introduced are interpreted to include all such modifications, permutations, additions and sub-combinations as are within their true spirit and scope. The applicant or applicants have attempted to disclose all the embodiments of the invention that could be reasonably foreseen. There may be unforeseeable insubstantial modifications that remain as equivalents.

I claim:

1. A wig form for supporting a wig or hair piece comprising:

a mandrel, and a torus-shaped member, the mandrel removably located within a lumen of the torus-shaped member; and a wig or hair piece having a weft track with strands of hair having a root end and a tip end, wherein each strand of hair is attached along a length of the weft track by the root end and includes a curl, wherein when the weft track is removably attached to the torus-shaped member, the curl of each strand of hair extends over a curved surface of the torus-shaped member to preserve the curls.

2. The wig form of claim 1, wherein one or both of the mandrel and the torus-shaped member comprises polystyrene, polybutadiene, polyethylene, polyurethane, cardboard, or papier-mache.

3. The wig form of claim 1, wherein one or both of the mandrel and the torus-shaped member comprises foamed plastic.

4. The wig form of claim 1, wherein one or both of the mandrel and the torus-shaped member comprises flexible plastic filled with air or water.

5. A wig or hair piece storage device comprising:

the wig form of claim 1; and a box including:

an approximately square base having a floor and four vertical walls, a circular retainer comprised of a band having a height approximately that of the vertical walls of the base, the retainer located within the base, wherein the mandrel of the wig form includes a height approximately that of the vertical walls of the base, wherein the torus-shaped member of the wig form includes a height approximately that of the vertical walls of the base and an exterior diameter approximately that of the retainer, wherein the torus-shaped member is located within the retainer, and wherein the mandrel is located within a lumen of the torus-shaped member, and an approximately square lid with vertical walls, the walls interacting with the walls of the base when the box is closed by the lid.

6. The wig or hair piece storage device of claim 5, wherein the wig box further comprises: a window in the lid.

7. The wig form of claim 1, wherein one or both of the mandrel and the torus-shaped member comprises rubber filled with air or water.

8. The wig form of claim 1, further comprising a hair net extending over the wig or hair piece on the wig form.

9. The wig form of claim 1, wherein the mandrel is cylindrical.

10. An apparatus for preserving a wig or hair piece, comprising:

a wig form including a first member; and a second torus-shaped member having a curved annular surface, the first member sized and configured to be removably received within a central hole defined by the second torus-shaped member;

a wig or hair piece comprising:

a strip; and strands of hair having a root end and a tip end, wherein the root end of each strand of hair is attached to the strip, wherein each strand of hair includes a curl, and wherein the strip is removably attached to the second torus-shaped member and the curl of each strand of hair extends over a curved surface of the second torus-shaped member to preserve the curls.

11. The apparatus for preserving a wig or hair piece of claim 10, further comprising a hair net extending over the wig or hair piece on the wig form.

12. The apparatus for preserving a wig or hair piece of claim 11, further comprising a box, wherein the wig form is received within the box.

13. The apparatus for preserving a wig or hair piece of claim 12, wherein the box comprises:

an approximately square base having a floor and four vertical walls, a circular retainer including a band having a height approximately that of the vertical walls of the base, the retainer located within the base, wherein the first member of the wig form includes a height approximately that of the vertical walls of the base, wherein the second torus-shaped member of the wig form includes a height approximately that of the vertical walls of the base and an exterior diameter approximately that of the retainer, wherein the second torus-shaped member is located within the retainer, and wherein the first member of the wig form is located within the central hole of the second torus-shaped member; and an approximately square lid with vertical walls, the walls interacting with the walls of the base when the box is closed by the lid.

14. The apparatus for preserving a wig or hair piece of claim 13, wherein the box further comprises a window in the lid.

15. The apparatus for preserving a wig or hair piece claim 10, wherein the first member of the wig form is substantially cylindrical.

* * * * *